United States Patent [19]

Konta

[11] 4,223,889

[45] Sep. 23, 1980

[54] BUMPER STRUCTURE INCLUDING DRIVE MECHANISM

[75] Inventor: Yukio Konta, Gardena, Calif.

[73] Assignee: Tomy Kogyo Co., Inc., Tokyo, Japan

[21] Appl. No.: 956,056

[22] Filed: Oct. 30, 1978

[30] Foreign Application Priority Data

Aug. 28, 1978 [JP] Japan ..... 53-104714

[51] Int. Cl.[3] ..... A63F 7/00

[52] U.S. Cl. ..... 273/127 R; 273/121 A; 273/129 P

[58] Field of Search ..... 124/10; 273/129 R, 129 D, 273/127 R, 127 C, 121 R, 121 A, 121 D, 121 E, 129 P

[56] References Cited

U.S. PATENT DOCUMENTS 3,785,653 1/1974 Halliburton ..... 273/127R 4,065,129 12/1977 Bartok ..... 273/121 A

*Primary Examiner*—Richard C. Pinkham

*Assistant Examiner*—T. Brown

*Attorney, Agent, or Firm*—Edward D. O'Brian

[57] ABSTRACT

A ball bumper structure primarily intended for use in pinball type games can be constructed so as to utilize first and second members mounted so as to be capable of being pivoted relative to a platform. The first member includes a bumper surface exposed at the front of the platform and the second member includes another bumper surface located opposite the first bumper surface. When an object such as a ball contacts the first bumper surface the weight of the object and/or the force of such contact is employed to move the first movable member so as to discharge a latch structure. When the latch structure is disengaged an actuation structure including an impulse drive rapidly moves the second bumper surface toward the first. These surfaces are preferably tapered so that when a ball is caught between the two bumper surfaces as the second is being moved toward the first the ball will be forced outwardly away from the bumper structure.

16 Claims, 3 Drawing Figures

BUMPER STRUCTURE INCLUDING DRIVE MECHANISM

BACKGROUND OF THE INVENTION

The invention set forth in this specification pertains to a new and improved bumper structure including a drive mechanism which is primarily intended for use in pinball or pinball type games.

Commonly pinball or pinball type games are constructed so that an appropriately actuated ball is allowed to move or roll along the front of a platform into engagement with one or more different types of obstacles or structures which tend to alter the motion of such a ball. The expression "bumper structure" is employed with pinball type games to designate structures which are adapted to be engaged by balls and which are adapted to provide some sort of action or reaction as a result of being so engaged.

Certain prior art bumper structures merely cause the actuation of lights or a score mechanism when engaged. Frequently such bumper structures are essentially spring mechanisms which alter the path a ball will travel along a front surface of a platform in a pinball-type game. At the present time the term "bumper structure" is increasingly being utilized to designate structures which, when engaged by a ball, apply a force to the ball so as to propel the ball away from the bumper mechanism in a manner dependent upon the way the ball has engaged the bumper structure.

Such bumper mechanism structures which are constructed so as to apply a force to a ball are frequently considered as employing a drive mechanism since they tend to propel or drive the ball away from the bumper structure. In the past many of such bumper mechanisms or structures employing a drive mechanism have been constructed so as to utilize electrical means such as solenoids to provide the mechanical force necessary to propel a ball. It is considered that such structures are comparatively disadvantageous because of the costs involved in constructing them. In certain fields such as in the field of comparatively inexpensive toys intended for household use costs are quite important. It has long been recognized that as a general rule cost savings can frequently be achieved by utilizing comparatively simple mechanical structures instead of electric or electronic devices for the same purpose. There are, of course, many exceptions to this.

In the past a number of efforts have been made at providing bumper structures employing a drive mechanism constructed so as to utilize a mechanical structure to provide a mechanical force necessary to propel a ball. Certain of such mechanical structures have employed a rotating member in a bumper structure which is adapted to be engaged by a ball and then to deflect the ball outwardly. Such structures impart movement to a ball in accordance with the rotation of the rotating member used in them. This is not necessarily desirable in a pinball type game. Frequently it is desirable to use a bumper mechanism which propels a ball outwardly from the bumper structure in a manner reasonably corresponding to the manner in which a ball rebounds against a spring in such a game.

To a degree this rebound-type propulsion action has been achieved in a mechanical bumper structure constructed so that the weight of a ball entering the bumper structure engages a member so as to move the member downwardly into engagement with a rotary wheel.

Such engagement imparts a rotary force component to the member causing it to move upwardly in such a manner that the ball initially causing the movement is clamped between sloping surfaces so as to be propelled outwardly from the bumper structure. Although this type of structure is unquestionably utilitarian it is considered to impart to the ball at least some minor degree of rotation resulting from the rotation of the movable member. This, of course, will tend to prevent the ball from reasonably simulating a rebound action achieved with a spring-type rebound structure. This type of structure also has the disadvantage that the dimension and configuration of the bumper structure are limited by the mode of operation employed.

BRIEF SUMMARY OF THE INVENTION

A broad object of the present invention is to provide a new and improved bumper structure including a drive mechanism which is more desirable than prior bumper structures as indicated in the preceding discussion. A related objective of the invention is to provide bumper structures as described which effectively simulate the rebound action occuring when a ball rebounds off a spring or spring-type structure. Another objective of the invention is to provide a bumper structure as indicated which need not be of a "round" configuration but which can also be of an elongated, bar-like character. Further objectives of the invention are to provide bumper structures which may be easily and conveniently manufactured at a comparatively nominal cost, which are effective for their intended purpose, and which may be utilized over a prolonged period without requiring repair or maintenance.

In accordance with this invention these various objectives are achieved by providing a bumper structure which comprises: a platform having a front and a back, a first movable member located adjacent to the platform, the first movable member having a first bumper surface exposed at the front of the platform, a first mounting means for mounting the first movable member relative to the platform so that the first movable member can be moved with respect to the front of the platform, a first biasing means for biasing the first movable member in a normal position in which the first bumper surface is located so that it can be contacted by a ball moving along the front of the platform and so that such contact of a ball with the first bumper surface will move the first movable member out of the normal position, a second movable member located adjacent to the platform, the second movable member having a second bumper surface located so as to be spaced from the first bumper surface, a second mounting means for mounting the second movable member so that the second movable member can be moved so that the second bumper surface is moved toward the first bumper surface, a second biasing means for biasing the second movable member in a normal position in which the second bumper surface is spaced from the first bumper surface, actuation means for moving the second movable member from its normal position so that the second bumper surface is moved toward the first bumper surface, the actuation means being operatively associated with the second movable member, and latch means for rendering the actuation means inoperative to move the second movable member, the latch means normally connecting said first movable member and the actuation means and being capable of being disengaged so as to allow the actuation means to move the second movable member.

BRIEF DESCRIPTION OF THE DRAWING

Because of the nature of the invention it is considered it is best more fully explained with reference to the accompanying drawing in which.

The particular bumper structures illustrated are constructed so as to utilize the operative concepts or principles of the invention set forth and defined in the appended claims forming a part of this disclosure. It is considered that those concepts or principles can be easily applied in other somewhat differently constructed and differently appearing bumper structures through the use or exercise of routine engineering skill.

DETAILED DESCRIPTION

Figure 1:
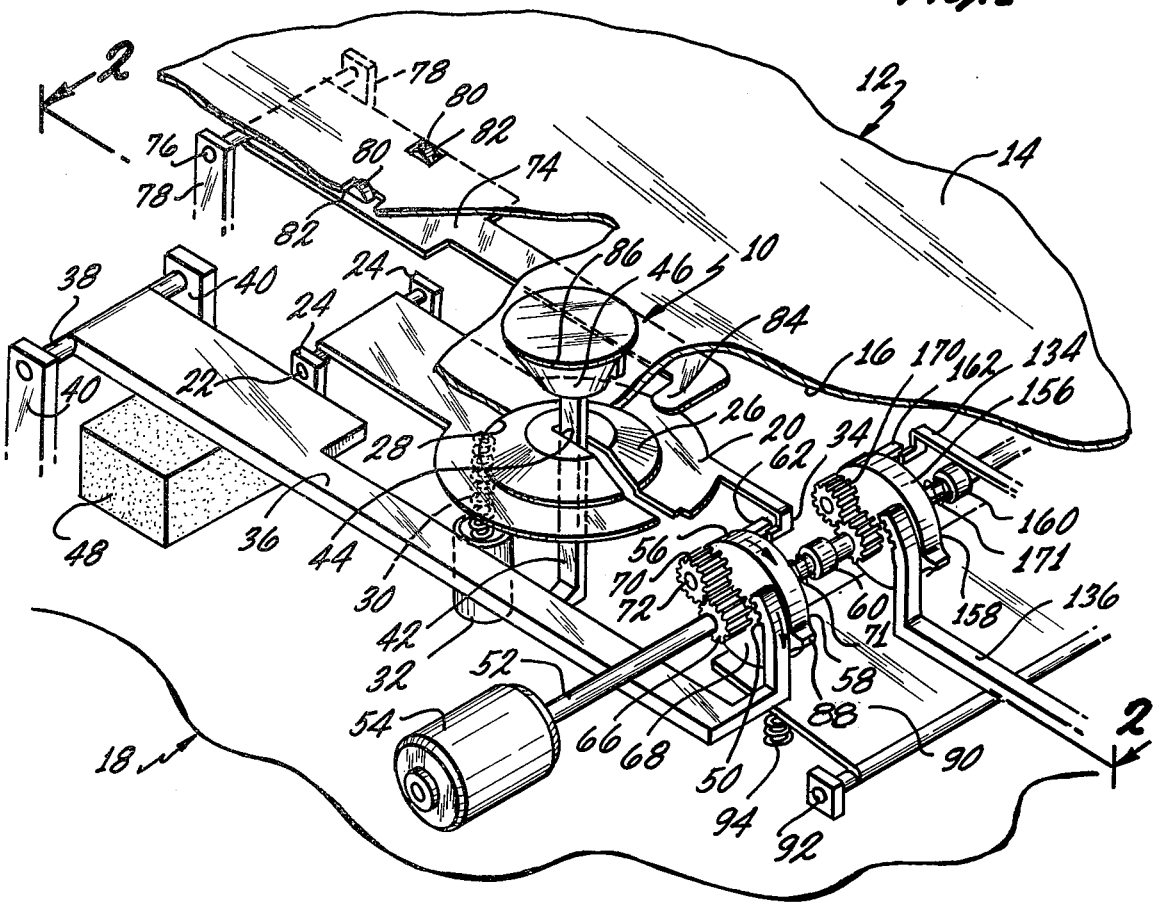
FIG. 1 is an isometric view of a presently preferred embodiment or form of a bumper structure in accordance with this invention in association with a playing platform such as the playing surface of a pinball or pinball-type game on a housing in this figure; the platform and the housing are partially broken away so as to expose details of the bumper structure and the drive mechanism used with it.
Figure 2:
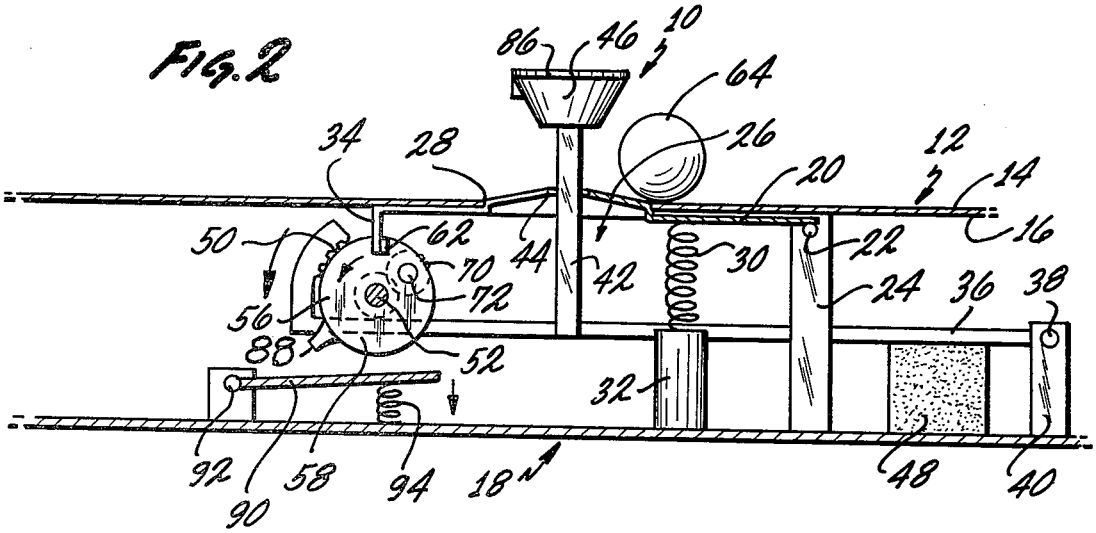
FIG. 2 is a partial cross-sectional view corresponding to a cross-sectional view taken at line 2—2 of FIG. 1 showing a ball contacting the bumper structure and the position of certain parts shortly after such contact.

In FIGS. 1 and 2 of the drawing there is shown a bumper structure 10 in accordance with this invention which is oriented with respect to a platform 12 having a front 14 and a back 16. This platform 12 constitutes a normal playing surface of a pinball or pinball-type game and, of course, is intended to be supported within a conventional housing 18. A first movable member 20 is mounted through the use of trunnions 22 engaging bearings 24 so as to be capable of pivoting relative to the platform 12. In a "normal" position this first member 20 is located so that a conical first bumper surface 26 extends through an opening 28 in the platform 12 so as to appear more or less as an extension of the front 14 of this platform 12. The first member 20 is biased in this normal position by means of a small coil spring 30 held in a retainer 32 carried by the housing 18. This first member 20 includes a downwardly extending lever 34 forming a part of a latch structure or means (not separately numbered) as hereinafter more specifically indicated.

The bumper structure 10 also includes a second movable member 36 which is mounted through the use of other trunnions 38 engaged within bearings 40 on the housing 18 so as to also be capable of pivoting relative to the platform 12. In a "normal" position this second member 36 is located so that an upward extension 42 of it extends through an opening 44 in the bumper surface 26 generally above the front 14 of the platform 12. This extension 42 carries a conical second bumper surface 46 so that this bumper surface 46 is spaced from the surface 26 and is capable of being moved toward the bumper surface 26. The second member 36 is biased in this normal position by means of a small resilient foam rubber pad 48 serving as a spring. This pad 48 is located between the housing 18 and the second bumper member 36. This second bumper member 36 carries a somewhat sector-like gear rack 50 forming a part of an actuation or drive structure or means (not separately numbered) as hereinafter more specifically indicated utilized in the complete bumper structure 10 illustrated.

This actuation or drive structure includes an elongated shaft 52 which is adapted to be continuously rotated through the use of a small motor 54. A disk 56 is located concentrically about the shaft 52 so as to be freely rotatable relative to this shaft 52. One surface 58 of this disk 56 is positioned by means of a thrust bearing 60 on the shaft 52 adjacent to the lever 34 so that this lever 34 will engage a stop lug 62 on this surface 58 when the first member 26 is in the normal position noted. This lever 34 and the stop lug 62 are considered to constitute the latch structure or means referred to in the preceding. They are used to hold the disk 56 against rotation when the shaft 52 is rotated in a clockwise direction as indicated in FIG. 1. The lever 34 will disengage the lug 62 to permit rotation of the disk 56 whenever the first member 26 is pivoted downwardly from its normal position. The spring 30 is of such a strength as to permit this to occur whenever the surface 26 is engaged by a ball 64 as indicated in FIG. 2 of the drawing.

The shaft 52 is secured to a small spur gear 66 immediately adjacent to a surface 68 of the disk 56 remote from the surface 58. This spur gear 66 continuously mates with a small planetary gear 70 mounted upon a shaft 72 extending from the surface 68. This planetary gear 70 is located on the surface 68 so as to be capable of contacting the rack 50 during rotation of the disk 56 in a clockwise direction as viewed in FIG. 1 so as to transmit movement to the rack 50 causing the second member 36 to be moved against the resiliency of the pad 48 in such a manner as to move the bumper surface 46 toward the bumper surface 26. This structure is designed so that after such movement the rack 50 will be released from the planetary gear 70 so that the pad 48 will automatically return the second member 36 to its initial, normal position.

The rack 50, the planetary gear 70, the disk 56 and the spur gear 66 in effect cooperate with one another so as to constitute what may be referred to as an impulse drive means (not separately numbered). These parts cooperate with one another so as to provide a relatively rapid or sudden application of force to the second member 36 so as to drive the second member 36 downward in order to move the surface 46 toward the surface 26. Such movement provides a clamping action against the ball 64 by the surfaces 26 and 46 shortly after the weight of the ball 64 or the force of the ball hitting the surface 26 has caused rotation of the member 26. This clamping action tends to force the ball 64 outwardly from the structure 10 in a manner to a resonable degree simulating the rebound of a ball against a cylindrical spring-like or type bumper structure (not shown).

To a degree it may be considered that the mechanism described employs a clutch because the disk 56 is rotatable relative to the shaft 52 and because the surface 68 is located adjacent to the spur gear 66. Normally friction between the adjacent parts indicated will be sufficient so that the disk 56 turns or rotates whenever the lever 34 is disengaged from the lug 62. If desired, however, a small coil spring 71 may be located between the thrust bearing 60 and the disk 56 so as to bias the disk 56 into engagement with the spur gear 66 to make sure that there will be adequate friction in the "system" so that the disk 56 will rotate each time the lever 34 is disengaged from the lug 62.

The structure 10 can be utilized in a complete pinball game (not shown) in order to accomplish several secondary functions. As an example of this an elongated lever 74 may be pivotally mounted relative to the platform 12 through the use of trunnions 76 and bearings 78 in such a manner that a surface 80 on this lever 74 passes upwardly through another opening 82 in the platform 12. This surface 80 is located so that it can be engaged by a ball such as the ball 64 moving along the front 14 of the platform 12. This lever 74 is provided with a small extension 84 overlying the first member 20. Because the spring 30 acts against the first member 20 this spring 30 will indirectly bias the lever 74 to a normal position as illustrated in FIG. 1. With this structure the weight of a ball 64 on the surface 80 will normally pivot the lever 74 downwardly so as to cause the extension 84 to pivot the lever 20 to a sufficient extent to cause disengagement of the lever 34 from the lug 62. This will cause the sequence of actions previously described resulting in the bumper surface 46 being moved toward the bumper surface 26.

By experimentation the surface 80 may be located relative to the two bumper surfaces 26 and 46 so that as a ball such as the ball 64 rolls on the platform 12 such a ball will engage the surface 80 before it reaches the bumper surface 26. As a consequence of this a ball 64 which has served to rotate the lever 74 will not be propelled outwardly as indicated in the preceding but will normally merely hit against the edge 86 of the bumper surface 46 so as to rebound off this edge 86 in the manner in which a ball will normally rebound off an object or surface.

Another secondary function capable of being accomplished with the structure 10 pertains to the actuation of an appropriate score counting mechanism. If desired a peripheral cam 88 may be located on the disk 56 immediately above a lever 90 secured to a pivotally mounted shaft 92. This lever 90 will normally bias generally toward the disk 56 by means of a small spring 94. The cam 88 will engage the lever 90 each time the disk 56 rotates so as to cause the lever 90 to transmit limited rotation to the shaft 92. When the shaft 92 is connected to an appropriate conventional counter mechanism (not shown) such a counter mechanism will be actuated to indicate a score each time the disk 56 rotates. Similar results can, of course, be achieved by coupling a conventional counter mechanism directly to either of the movable members 20 and 36.

Figure 3:
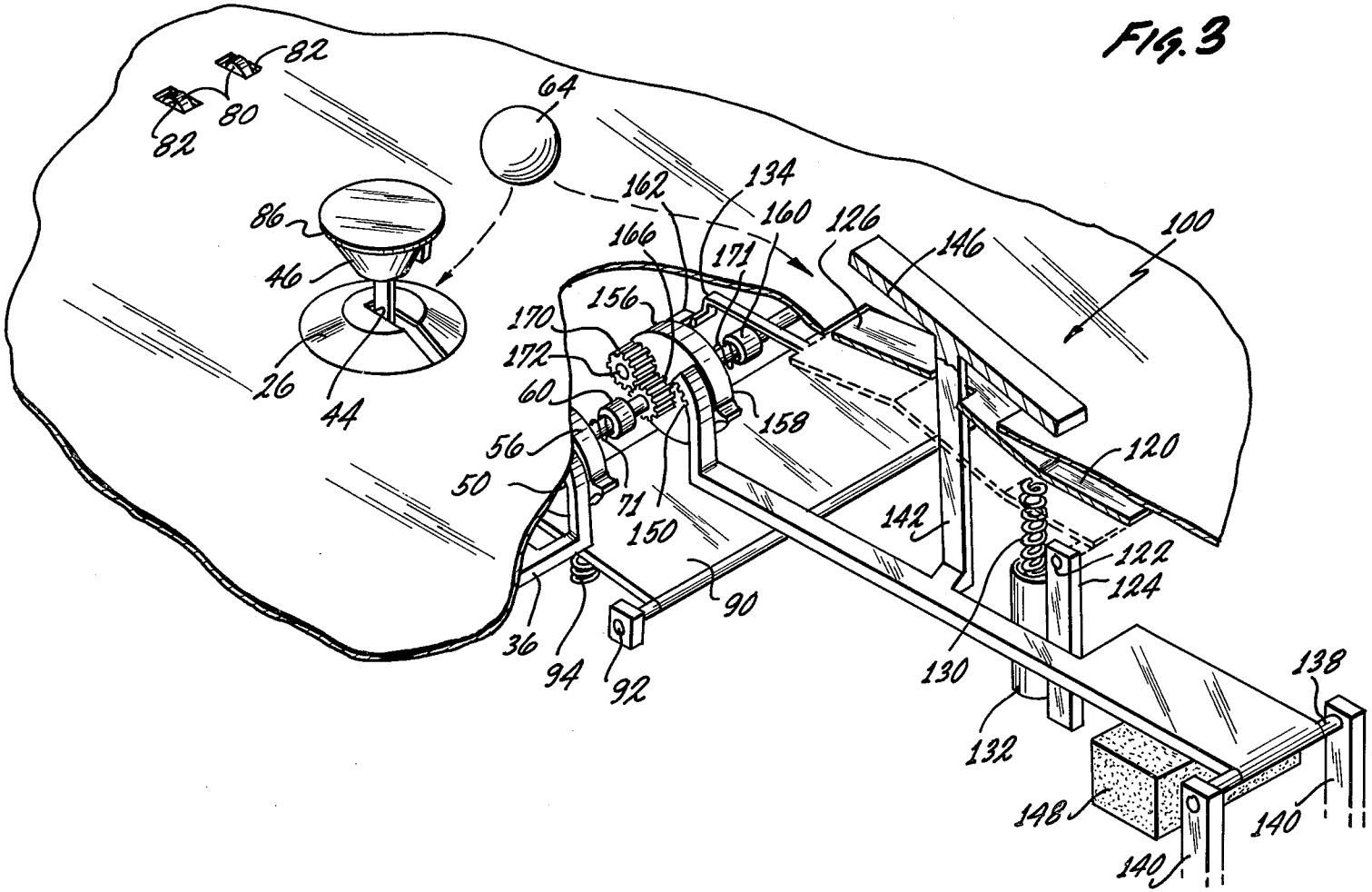
FIG. 3 is a view similar to FIG. 1 of a modified bumper structure which primarily differs from the bumper structure shown in FIG. 1 in connection with the shapes of bumper surfaces employed.

In FIG. 3 of the drawing there is shown a modified bumper structure 100 which is substantially the same as the bumper structure 10 described in the preceding discussion. For convenience and in the interest of brevity the various parts of the bumper structure 100 are not separately described herein except in connection with the differences between the two structures 10 and 100 and the various parts of the structure 100 are indicated in the remainder of this specification and in the drawing by the numerals previously used to describe such parts preceded by the number "1".

The bumper structure 100 differs from the structure 10 in that the first bumper surface 126 is not of a conical shape but instead has the shape of an elongated wedge. In the structure 100 the second bumper surface 146 is of a similar elongated, wedge-like shape. These two surfaces 126 and 146 are located relative to one another so as to achieve the same clamping type action which will force the ball outwardly from between them described in the preceding in connection with the structure 10.

This modified structure 100 is believed to illustrate one of the versatilities of the invention set forth in this specification. It illustrates how the principles of the invention are not limited in application to essentially a round or cylindrical type bumper structure but instead can be applied to elongated bumper structures as may be desired in achieving particular actions in a pinball-type game.

With the present invention it is possible to utilize any desired number of bumper structures in connection with a single rotating shaft such as the shaft 52 described in the preceding so that all of the structures are powered simultaneously by the same shaft. This is considered desirable from an economic standpoint. Such bumper structures used with a common shaft drive may be located adjacent to one another on one side of the shaft or on both sides of the shaft used.

I claim:

1. A ball bumper structure which comprises:

a platform having a front and a back, a first movable member located adjacent to said platform, said first movable member having a first bumper surface exposed at the front of said platform, a first mounting means for mounting said first movable member relative to said platform so that said first movable member can be moved with respect to the front of said platform, a first biasing means for biasing said first movable member in a normal position in which said first bumper surface is located so that it can be contacted by a a ball moving along the front of said platform and so that such contact of a ball with said first bumper surface will move said first movable member out of said normal position, a second movable member located adjacent to said platform, said second movable member having a second bumper surface located so as to be spaced from said first bumper surface, a second mounting means for mounting said second movable member so that said second movable member can be moved so that said second bumper surface is moved toward said first bumper surface, a second biasing means for biasing said second movable member in a normal position in which said second bumper surface is spaced from said first bumper surface, mechanical actuation means for moving said second movable member from its normal position so that said second bumper surface is moved toward said first bumper surface, said actuation means being operatively associated with said second movable member, and mechanical latch means for preventing said actuating means from moving said second movable member, said latch means having engaged and disengaged positions, said latch means normally connecting said first movable member and said actuation means, said latch means being disengagable as the result of movement of said first movable member from its normal position so as to allow said actuation means to move said second movable member, said latch means being automatically engagable so as to prevent movement of said second movable member when said first movable member is in its normal position.

2. A small bumper structure as claimed in claim 1 wherein:

said actuation means includes a shaft, motor means for continuously rotating said shaft and impulse drive means for transmitting motion from said shaft to said second movable member when said latch means is disengaged.

3. A ball bumper structure as claimed in claim 1 wherein:

said first mounting means comprises trunnion and bearing means mounting said first movable member so that it may be pivoted relative to said platform, and said second mounting means comprises trunnion and bearing means mounting said second movable member so that it may be pivoted relative to said platform.

4. A ball bumper structure as claimed in claim 1 wherein:

said first biasing means comprises a resilient member and said second biasing means comprises a resilient member.

5. A ball bumper mechanism as claimed in claim 1 including:

a third movable member located adjacent to said platform, said third movable member having a front surface exposed at the front of said platform, a third mounting means for mounting said third movable member relative to said platform so that said third movable member can be moved with respect to said platform, said third movable member being capable of being moved into engagement with said second movable member so as to cause movement of said second movable member in order to move said second movable member to cause disengagement of said latch means, and wherein said actuation means includes a shaft, motor means for continuously rotating said shaft and impulse drive means for transmitting motion from said shaft to said second movable member when said latch means is disengaged, said impulse drive means includes a disk mounted on said shaft so as to be rotatable with respect to said shaft, a planetary gear means rotatably mounted on said disk so as to extend from one side thereof with its axis parallel to the axis of said shaft, a spur gear means secured to said shaft so as to rotate therewith, said spur gear means being in continuous contact with said planetary gear means, said latch means includes a lever located on said first movable member and a stop lug on said disk, said lever engaging said stop when said first movable member is in its normal position so as to prevent rotation of said disk, and rack means capable of being engaged by said planetary gear means during a part of rotation of said disk located on said second movable member, said first biasing means comprises a resilient member and said second biasing means comprises a resilient member, said first bumper surface is located adjacent to said front of said platform so that a ball rolling along said front of said platform can roll onto said first bumper surface, said second bumper surface is located opposite said first bumper surface on said front of said platform, said first mounting means pivotally mounts said first movable member adjacent said back of said platform, said second mounting means pivotally mounts said second movable member adjacent to said back of said platform.

6. A ball bumper structure as claimed in claim 5 including:

movable means for transmitting motion to a counter mechanism, cam means located on said disk so as to extend therefrom, said cam means and said movable means for transmitting motion being located with respect to one another so that said cam means moves said movable means each time said disk rotates.

7. A ball bumper mechanism as claimed in claim 1 including:

a third movable member located adjacent to said platform, said third movable member having a surface exposed at the front of said platform, a third mounting means for mounting said third movable member relative to said platform so that said third movable member can be moved with respect to the front of said platform, said third movable member overlying a part of said first movable member so that as said surface on said third movable member is contacted by a ball moving along the front of said platform such contact will move said third movable member so as to cause movement of said first movable member.

8. A ball bumper structure as claimed in claim 1 including:

movable means for transmitting motion to a counter mechanism, cam means located on said actuation means so as to extend therefrom, said cam means and said movable means for transmitting motion being located with respect to one another so that said cam means moves said movable means each time said actuation means moves said second movable member from its normal position.

9. A ball bumper structure as claimed in claim 1 including:

a third movable member located adjacent to said platform, said third movable member having a surface exposed at the front of said platform, a third mounting means for mounting said third movable member relative to said platform so that said third movable member can be moved with respect to the front of said platform, said third movable member overlying a part of said first movable member so that as said surface on said third movable member is contacted by a ball moving along the front of said platform such contact will move said third movable member so as to cause movement of said first movable member, movable means for transmitting motion to a counter mechanism, cam means located on said actuation means so as to extend therefrom, said cam means and said movable means for transmitting motion being located with respect to one another so that said cam means moves said movable means each time said actuation means moves said second movable member from its normal position.

10. A ball bumper structure which comprises:

a platform having a front and a back, a first movable member located adjacent to said platform, said first movable member having a first bumper surface exposed at the front of said platform, a first mounting means for mounting said first movable member relative to said platform so that said first movable member can be moved with respect to the front of said platform, a first biasing means for biasing said first movable member in a normal position in which said first bumper surface is located so that it can be contacted by a ball moving along the front of said platform and so that such contact of a ball with said first bumper surface will move said first movable member out of said normal position, a second movable member located adjacent to said platform, said second movable member having a second bumper surface located so as to be spaced from said first bumper surface, a second mounting means for mounting said second movable member so that said second movable member can be moved so that said second bumper surface is moved toward said first bumper surface, a second biasing means for biasing said second movable member in a normal position in which said second bumper surface is spaced from said first bumper surface, actuation means for moving said second movable member from its normal position so that said second bumper surface is moved toward said first bumper surface, said actuation means being operatively associated with said second movable member, said actuation means includes a shaft, motor means for continuously rotating said shaft and impulse drive means for transmitting motion from said shaft to said second movable member when said latch means is disengaged, said impulse drive means includes a disk mounted on said shaft so as to be rotatable with respect to said shaft, a planetary gear means rotatably mounted on said disk so as to extend from one side thereof with its axis parallel to the axis of said shaft, a spur gear means secured to said shaft so as to rotate therewith, said spur gear means being in continuous contact with said planetary gear means, latch means for rendering said actuation means inoperative to move said second movable member, said latch means normally connecting said first movable member and said actuation means and being capable of being disengaged so as to allow said actuation means to move said second movable member, said latch means includes a lever located on said first movable member and a stop lug on said disk, said lever engaging said stop when said first movable member is in its normal position so as to prevent rotation of said disk, and rack means capable of being engaged by said planetary gear means during a part of rotation of said disk located on said second movable member.

11. A ball bumper structure as claimed in claim 10 wherein:

said first mounting means comprises trunnion and bearing means mounting said first movable member so that it may be pivotal relative to said platform, and said second mounting means comprises trunnion and bearing means mounting said second movable member so that it may be pivoted relative to said platform.

12. A ball bumper structure which comprises:

a platform having a front and a back, a first movable member located adjacent to said platform, said first movable member having a first bumper surface exposed at the front of said platform, said first bumper surface is located adjacent to said front of said platform so that a ball rolling along said front of said platform can roll onto said first bumper surface, a first mounting means for mounting said first movable member relative to said platform so that said first movable member can be moved with respect to the front of said platform, said first mounting means pivotally mounting said first movable member adjacent said back of said platform, a first biasing means for biasing said first movable member in a normal position in which said first bumper surface is located so that it can be contacted by a ball moving along the front of said platform and so that such contact of a ball with said first bumper surface will move said first movable member out of said normal position, a second movable member located adjacent to said platform, said second movable member having a second bumper surface located so as to be spaced from said first bumper surface, said second bumper surface is located opposite said first bumper surface on said front of said platform, a second mounting means for mounting said second movable member so that said second movable member can be moved so that said second bumper surface is moved toward said first bumper surface, said second mounting means pivotally mounts said second movable member adjacent to said back of said platform, a second biasing means for biasing said second movable member in a normal position in which said second bumper surface is spaced from said first bumper surface, actuation means for moving said second movable member from its normal position so that said second bumper surface is moved toward said first bumper surface, said actuation means being operatively associated with said second movable member, and latch means for rendering said actuation means inoperative to move said second movable member, said latch means normally connecting said first movable member and said actuation means and being capable of being disengaged so as to allow said actuation means to move said second movable member.

13. A ball bumper structure as claimed in claim 12 including:

a third movable member located adjacent to said platform, said third movable member having a surface exposed at the front of said platform, a third mounting means for mounting said third movable member relative to said platform so that said third movable member can be moved with respect to the front of said platform, said third movable member overlying a part of said first movable member so that as said surface on said third movable member is contacted by a ball moving along the front of said platform such contact will move said third movable member so as to cause movement of said first movable member, movable means for transmitting motion to a counter mechanism, cam means located on said disk so as to extend therefrom, said cam means and said movable means for transmitting motion being located with respect to one another so that said cam means moves said movable means each time said disk rotates.

14. A ball bumper structure as claimed in claim 12 including:

a third movable member located adjacent to said platform, said third movable member having a surface exposed at the front of said platform, a third mounting means for mounting said third movable member relative to said platform so that said third movable member can be moved with respect to the front of said platform, said third movable member overlying a part of said first movable member so that as said surface on said third movable member is contacted by a ball moving along the front of said platform such contact will move said third movable member so as to cause movement of said first movable member, movable means for transmitting motion to a counter mechanism, cam means located on said actuation means so as to extend therefrom, said cam means and said movable means for transmitting motion being located with respect to one another so that said cam means moves said movable means each time said actuation means moves said second movable member from its normal position.

15. A ball bumper structure which comprises:

a platform having a front and a back, a first movable member located adjacent to said platform, said first movable member having a first bumper surface exposed at the front of said platform, a first mounting means for mounting said first movable member relative to said platform so that said first movable member can be moved with respect to the front of said platform, a first biasing means for biasing said first movable member in a normal position in which said first bumper surface is located so that it can be contacted by a ball moving along the front of said platform and so that such contact of a ball with said first bumper surface will move said first movable member out of said normal position, a second movable member located adjacent to said platform, said second movable member having a second bumper surface located so as to be spaced from said first bumper surface, a second mounting means for mounting said second movable member so that said second movable member can be moved so that said second bumper surface is moved toward said first bumper surface, a second biasing means for biasing said second movable member in a normal position in which said second bumper surface is spaced from said first bumper surface, actuation means for moving said second movable member from its normal position so that said second bumper surface is moved toward said first bumper surface, said actuation means being operatively associated with said second movable member, and latch means for rendering said actuation means inoperatively to move said second movable member, said latch means normally connecting said first movable member and said actuation means and being capable of being disengaged so as to allow said actuation means to move said second movable member, a third movable member located adjacent to said platform, said third movable member having a front surface exposed at the front of said platform, a third mounting means for mounting said third movable member relative to said platform so that said third movable member can be moved with respect to said platform, said third movable member being capable to being moved into engagement with said second movable member so as to cause movement of said second movable member in order to move said second movable member to cause disengagement of said latch means.

16. A ball bumper mechanism as claimed in claim 15 wherein:

said actuation means includes a shaft, motor means for continuously rotating said shaft and impulse drive means for transmitting motion from said shaft to said second movable member when said latch means is disengaged, said impulse drive means includes a disk mounted on said shaft so as to be rotatable with respect to said shaft, a planetary gear means rotatably mounted on said disk so as to extend from one side thereof with its axis parallel to the axis of said shaft, a spur gear means secured to said shaft so as to rotate therewith, said spur gear means being in continuous contact with said planetary gear means, said latch means includes a lever located on said first movable member and a stop lug on said disk, said lever engaging said stop when said first movable member is in its normal position so as to prevent rotation of said disk, and rack means capable of being engaged by said planetary gear means during a part of rotation of said disk located on said second movable member, said first biasing mens comprises a resilient member and said second biasing means comprises a resilient member, said first bumper surface is located adjacent to said front of said platform so that a ball rolling along said front of said platform can roll onto said first bumper surface, said second bumper surface is located opposite said first bumper surface on said front of said platform, said first mounting means pivotally mounts said first movable member adjacent said back of said platform, said second mounting means pivotally mounts said second movable member adjacent to said back of said platform.

* * * * *